US006010303A

United States Patent [19]

Feulner

[11] Patent Number: 6,010,303

[45] Date of Patent: Jan. 4, 2000

[54] APPARATUS AND METHOD OF PREDICTING AERODYNAMIC AND AEROMECHANICAL INSTABILITIES IN TURBOFAN ENGINES

[75] Inventor: Matthew R. Feulner, Tolland, Conn.

[73] Assignee: United Technologies Corporation, Hartford, Conn.

[21] Appl. No.: 09/129,337

[22] Filed: Aug. 5, 1998

[51] Int. Cl.[7] ..... F01B 25/12

[52] U.S. Cl. ..... 415/118; 415/26; 415/47; 415/49; 415/119

[58] Field of Search ..... 415/26, 28, 13, 415/14, 47, 48, 49, 118, 119; 73/660, 455

[56] References Cited

U.S. PATENT DOCUMENTS

| | | | |
|---|---|---|---|
| 4,573,358 | 3/1986 | Luongo | 73/660 |
| 4,895,026 | 1/1990 | Tada | 73/721 |
| 5,097,711 | 3/1992 | Rozelle et al. | 73/660 |
| 5,141,391 | 8/1992 | Acton et al. | 415/119 |
| 5,541,857 | 7/1996 | Walter et al. | 364/558 |
| 5,594,665 | 1/1997 | Walter et al. | 364/558 |
| 5,679,900 | 10/1997 | Smulders | 73/659 |

*Primary Examiner*—Edward K. Look
*Assistant Examiner*—Ninh Nguyen
*Attorney, Agent, or Firm*—McCormick, Paulding & Huber LLP

[57] ABSTRACT

A system and method is provided for generating a real-time signal indicative of an energy-type instability precursor in a turbofan engine. A sensor is positioned in a compressor portion of a turbofan engine for generating a real-time signal indicative of energy of aerodynamic or aeromechanical resonance waves generated in the compression system. The signal is bandpassed to generate a filtered signal within a predetermined range of frequencies indicative of a precursor to instability such as rotating stall, surge or flutter. The bandpassed signal is squared in magnitude and then low-passed to generate an instability precursor signal used to prevent imminent aerodynamic or aeromechanical instability from occurring in the aerocompression system.

13 Claims, 4 Drawing Sheets

APPARATUS AND METHOD OF PREDICTING AERODYNAMIC AND AEROMECHANICAL INSTABILITIES IN TURBOFAN ENGINES

FIELD OF THE INVENTION

The present invention relates to an apparatus and method of predicting the onset of aerodynamic and aeromechanical instabilities in turbofan engines, and more particularly relates to an apparatus and method of generating energy-type instability precursor signals in real-time which may predict the imminence of, for example, engine surge or stall or blade flutter in aeropropulsion compression systems in order to prevent such instabilities from occurring.

BACKGROUND INFORMATION

Turbofan engines are typically associated with running power plants or powering airplanes. With respect to airplanes, aerodynamic instabilities such as rotating stall or surge may catastrophically lead to sudden changes in engine power or engine failure. An aeromechanical instability such as fan blade flutter may lead to fan blade breakage and loss. A precursor to flutter is characterized by a damped resonance or elastic deformation of the turbofan blades at known frequencies. The blades have natural and associated harmonic frequencies of resonance which are based on the blade structure or configuration. An axial turbomachinery blade is associated with structural mode shapes which are the natural patterns and frequencies in which the blade deflects and resonates when excited. A blade has more than one mode shape and each mode shape resonates at a particular frequency. When an instability such as stall flutter occurs, it is usually associated with one particular structural mode. It is therefore vitally important to detect precursors to aeromechanical instability in aeropropulsion compression systems in order to dampen the instability dynamics and to prevent such imminent engine instability or failure.

Precursors to aerodynamic instabilities, such as rotating stall and surge are similar to that of flutter, but do not necessarily involve a physical displacement. These instabilities are purely aerodynamic in nature, involving fluctuations in local mass flow rate and pressure throughout the compression system. Precursors to these instabilities are the damped resonances in the aerodynamics before the system crosses the threshold of instability characterized by particular frequencies.

Methods have been implemented to predict such precursors to instability. For example, U.S. Ser. No. 08/809,497, filed Apr. 7, 1996 entitled "Precursor Measurements and Stall/Surge Avoidance in Aeroengine Systems" (Docket No. EH9927 (R3952)) the disclosure which is herein incorporated by reference, describes a method of measuring an energy-type quantity of a real-valued data signal in a given frequency range and using it for compressor surge/stall avoidance. Another method generates a signal indicative of an elastic deflection or resonance of the turbofan blades at the natural frequencies associated with precursors to such aeromechanical instabilities. For example, it is known to mount strain gauges on the fan blades and use the energy of a signal generated from the strain gauge over a particular frequency interval of blade resonance associated with stall flutter as a measure of the stability of the aerocompression system with the presumption that as a structural mode of the blades approaches instability (i.e., the fan blades resonate near the frequencies associated with imminent mechanical instabilities), the resonant response of the blades to noise or external forcing will increase and hence the energy of the response near the natural frequency of the structural mode will increase.

FIGS. 1*a* and 1*b* illustrate (in exaggerated form) blade resonance or energy waves generated in a turbofan 200 having eight blades 202, 204, 206, 208, 210, 212, 214 and 216. The blades 200–216 are shown in solid form corresponding to an undeflected state, and the blades 204–208 and 212–216 are also shown in phantom form corresponding to a deflected state during a resonance or elastic deformation of the blades which may arise due to stall flutter during blade rotation. FIG. 1*b* maps the degree of deformation of each blade during an instant of time where the amount of blade deformation in the direction of blade rotation is a positive value and the amount of blade deformation in the direction opposite to blade rotation is a negative value.

At an instant of time during rotation of the turbofan 200 in the clockwise direction, the blade 202 is shown in FIG. 1*a* to have no deformation which corresponds to a deformation value of zero units for the blade 202 as mapped in FIG. 1*b*. The blade 204 is shown in FIG. 1*a* to have a slight deformation in the direction of rotation which corresponds to a positive deformation of one unit for the blade 204 as mapped in FIG. 1*b*. The blade 206 is shown in FIG. 1*a* to have an even greater deformation relative to the blade 204 in the direction of rotation which corresponds to a positive deformation of two units for the blade 206 as mapped in FIG. 1*b*. The blade 208 is shown in FIG. 1*a* to have the same deformation as the blade 204 which corresponds to a positive deformation of one unit for the blade 208 as mapped in FIG. 1*b*.

The blade 210 is shown in FIG. 1*a* to have no deformation which corresponds to a deformation value of zero units for the blade 210 as mapped in FIG. 1*b*. The blade 212 is shown in FIG. 1*a* to have a slight deformation in a direction opposite to blade rotation which corresponds to a negative deformation of one unit for the blade 212 as mapped in FIG. 1*b*. The blade 214 is shown in FIG. 1*a* to have an even greater deformation relative to the blade 212 in the direction opposite to blade rotation which corresponds to a negative deformation of two units for the blade 214 as mapped in FIG. 1*b*. The blade 216 is shown in FIG. 1*a* to have the same deformation as the blade 212 which corresponds to a negative deformation of one unit for the blade 216 as mapped in FIG. 1*b*. The resonance pattern shown in FIGS. 1*a* and 1*b* correspond to one cycle of deformation for each blade in the positive and negative directions for each blade rotation. However, other excitation patterns characterized by multiple cycles of resonance generated in a blade during the course of a single rotation contribute to stall flutter or other precursors to mechanical instability in aerocompression systems.

The discrete Fourier transform (DFT) is a transformation of a finite discrete time-varying sequence (or time signal), such as an AC sinusoidal waveform into its representative discrete frequency sequence (its frequency content). The frequency content may contain both positive frequencies (blade resonance in a first direction as shown by the deformed blades 204–208 in FIG. 1*a*) or negative frequencies (blade resonance in a direction opposite to the first direction as shown by the deformed blades 212–216 in FIG. 1*a*). For example, as shown in FIG. 2*a*, a time-varying signal A (time sequence or signal) is a superposition of two sinusoidal waveforms B and C having respective frequencies 250 Hz and 500 Hz. As shown in FIG. 2*b*, the corresponding frequency content (frequency sequence or signal) of the signal A which is characteristic of DFTs can be visualized as two frequency spikes 218 and 220 mapped at respective frequencies of 250 Hz and 500 Hz. Each time sequence or signal has a unique frequency sequence when transformed into a DFT and vice-versa.

The frequency content of a time-varying signal as shown in its DFT can be used to determine properties of the time sequence. For example, in the analysis of mechanical instabilities associated with turbofan blades, it is common to examine the frequency content for particular frequencies related to instability which appear before the onset of the instability. Using the frequency content of a time-varying signal to form instability precursor signals is typically much more reliable than attempting to detect instability precursors by directly processing the time signal without generating DFTs.

One method for determining instability precursors based initially on time-varying signals is by taking discrete Fourier transforms (DFTs) of data segments or portions of the time-varying signal wherein each portion spans a small predetermined interval of time, squaring the magnitude of the data segments at each discrete frequency, and then summing the squared magnitudes of the data segments over the predetermined range of frequencies associated with mechanical instabilities. This method, however, is difficult to implement because it is a burdensome task to program the DFT algorithm and apply it to sequential data sequences.

A method described in the publication "Pre-Stall Behavior of Several High-Speed Compressors", ASME Paper 94GT-387 by Tryfonidis et al. is a direct application of employing DFTs as described above. However, the method splits the positive and negative frequencies associated with rotating stall and compares them to arrive at an indication of rotating stall which appears predominantly in the positive frequency direction. The precursor signal is the energy of the positive frequencies (the sum of the squares of the positive frequency part of the DFT sequence) minus the energy of the negative frequencies (the sum of the squares of the negative frequency part of the DFT sequence).

The foregoing Tryfonidis method relates to a time-varying signal which does not change its overall repetitive characteristics over time. When analyzing a time-varying signal, which may move further or closer to its instability point or frequencies associated with rotating stall, it is necessary to perform DFTs of short time sequences at repeated time intervals to capture the time-varying nature of the signal. However, this method is inefficient to implement since it involves the full DFT analysis of a signal whenever a new data point or portion of the time signal is acquired.

In response to the foregoing, it is an object of the present invention to overcome the drawbacks and disadvantages of prior art apparatus and methods for predicting and controlling aeromechanical instabilities in turbofan engines.

SUMMARY OF THE INVENTION

In one aspect, the invention provides a method for generating a real-time signal indicative of an energy-type instability precursor in a turbofan engine of an airplane or power plant. Energy waves associated with aerodynamic or aeromechanical resonances in an aerocompression system of a turbofan engine are sensed in real-time and a real-time signal indicative of the frequencies of resonance are generated therefrom. The real-time signal is bandpass filtered within a predetermined range of frequencies associated with the instability of interest in turbofan engines to form a bandpassed signal. The bandpassed signal is squared in magnitude to form a squared-magnitude signal. The squared-magnitude time domain signal is lowpass filtered to form an energy-type instability precursor signal which contains the energy associated with the instability of interest and varies in time according to the properties of the low pass filter. The instability precursor signal is used for predicting and preventing aerodynamic and aeromechanical instability from occurring within a turbofan engine.

In another aspect, the invention provides a system for generating a real-time signal indicative of an energy-type instability precursor in a turbofan engine used in airplanes. A sensor is positioned in a compressor portion of a turbofan engine for sensing signals associated with aerodynamic or aeromechanical resonance in a compressor portion of a turbofan engine and generating therefrom a real-time signal indicative of the damping of the resonance. A bandpass filter receives the real-time signal at an input and passes to an output a bandpass signal derived from the real-time signal within a predetermined range of frequencies associated with precursors to instabilities in turbofan engines. A multiplier circuit has two inputs each receiving the bandpassed signal for generating a squared-magnitude signal. A lowpass filter receives at an input the squared-magnitude signal to form a signal indicative of a precursor to aerodynamic or aeromechanical instability within a turbofan engine.

DETAILED DESCRIPTION OF THE PREFERRED EMBODIMENTS

The present invention takes advantage of Parseval's theorem which is a mathematical relation between time-varying signals and the frequency content of the signals. More specifically, Parseval's theorem states that the sum of the squared magnitudes of the time-varying signal (time sequence or signal) is proportional to the sum of the squared magnitudes of the DFT (frequency sequence or signal).

Figure 1B:
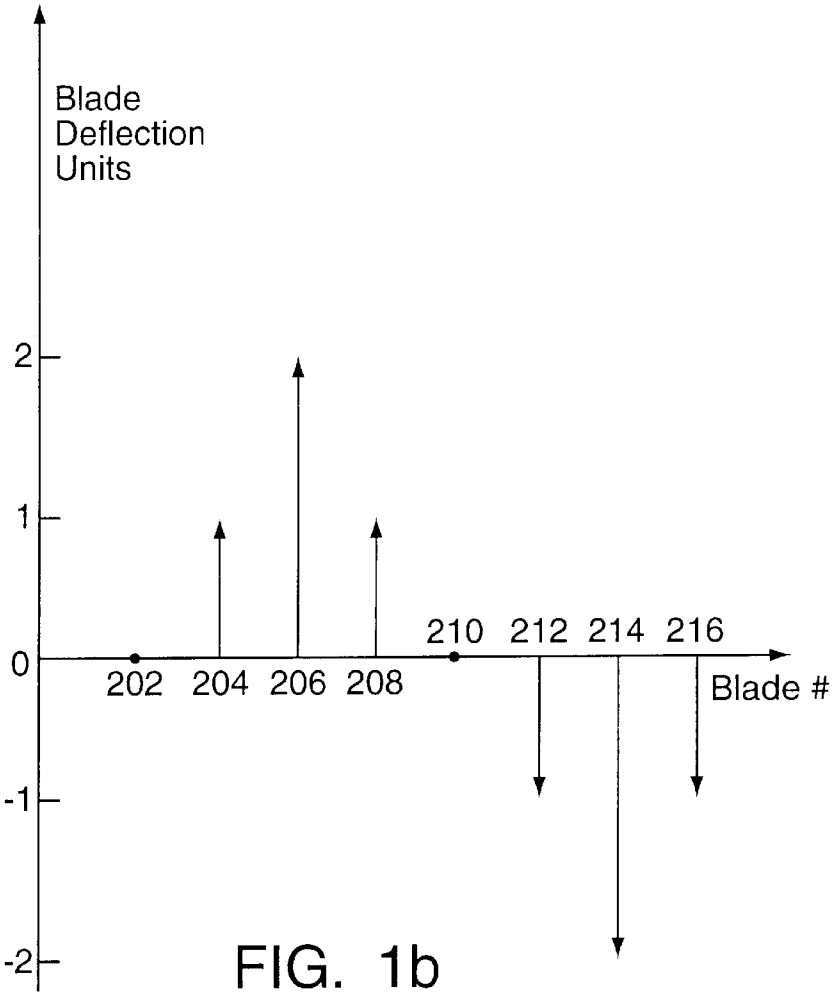
FIG. 1*b* schematically maps the degree of deflection of the blades shown in FIG. 1*a*.
Figure 1A:
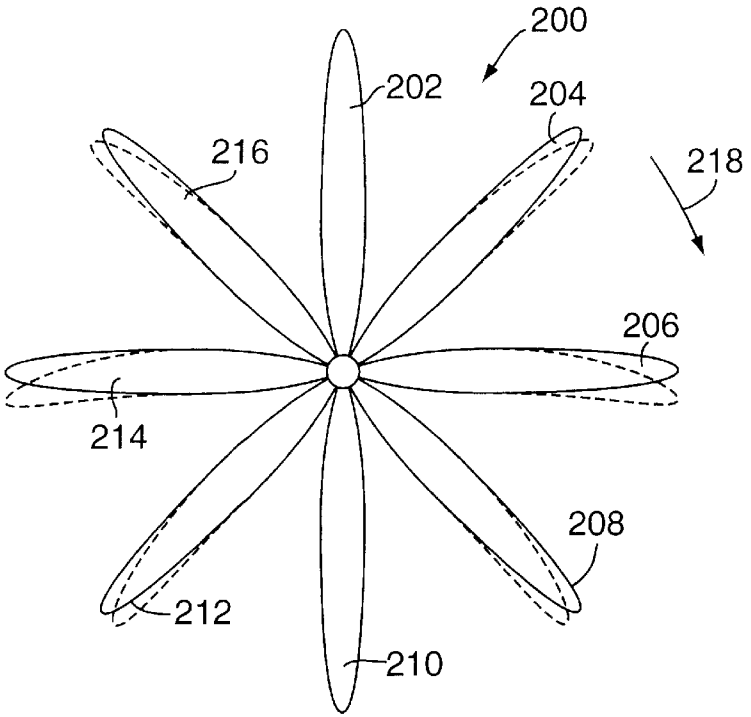
FIG. 1*a* schematically illustrates elastic deformation of turbofan blades at a natural frequency of excitation.
Figure 2B:
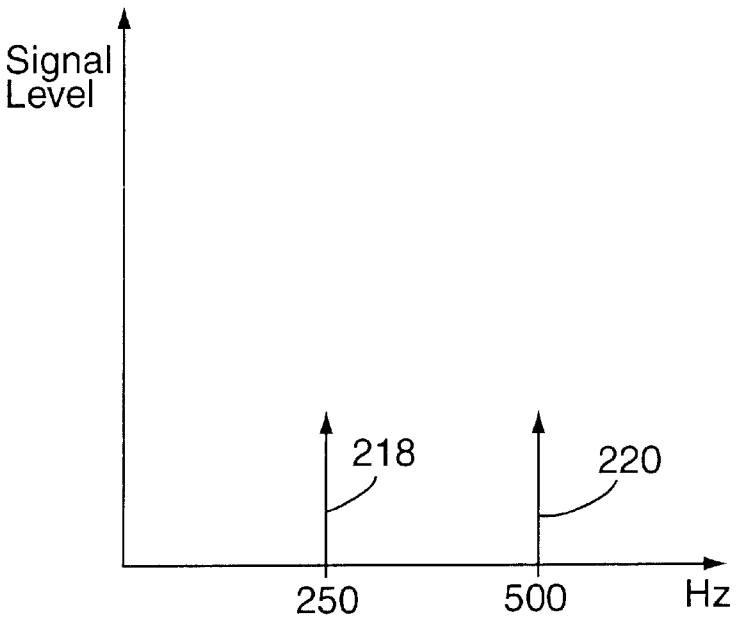
FIG. 2*b* is a graph mapping the signal of FIG. 2*a* into its constituent frequency components.
Figure 2A:
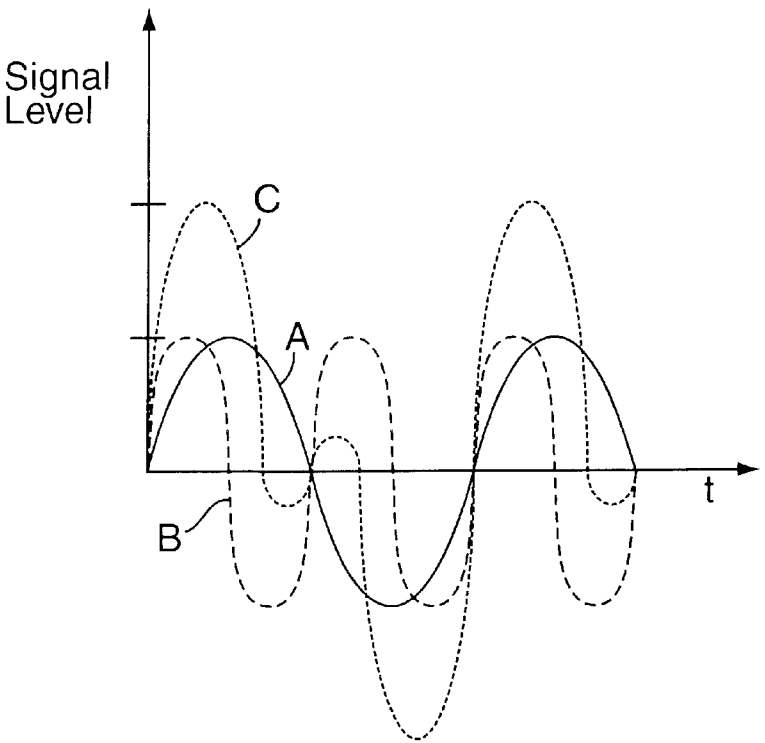
FIG. 2*a* is a graph illustrating a time-varying signal having frequency components as a function of time.

The advantage of employing Parseval's theorem is that if a time signal is bandpass filtered in real time using a simple filtering algorithm to eliminate frequencies outside the region of interest (i.e., frequencies not indicative of a mechanical instability), the precursor information based on the time signal over the frequency range of the bandpass filter can be calculated directly from the time signal by summing the squares of the bandpass filtered time sequence as will be explained more fully with respect to FIG. 1. In other words, the bandpass filter "bandpasses" or passes frequencies between two non-zero frequency values in a range including frequencies associated with aerodynamic or aeromechanical instabilities such as rotating stall, surge or flutter. This first step replaces the more complex DFT computation with a simpler bandpass filter.

As stated above, Parseval's theorem is applied to time-varying signals by summing the squares of the bandpass filtered time sequence. A simple way to implement the sum of squares operation is to employ a lowpass filter to filter the square of the bandpass filtered sequence. The lowpass filter "lowpasses" or passes frequencies between 0 Hz and a frequency representing the time scale at which the compression system changes damping. The lowpass filtering operation effectively yields a continuously changing or updated average of the sum of the squares of each frequency component of the bandpassed signal passed by the lowpass filter. The cut-off frequency of the lowpass filter is related to the number of averaging operations to perform per unit of time. In other words, choosing the cut-off frequency of the lowpass filter is equivalent to choosing the length of time over which to perform each energy computation. Increasing the cut-off frequency is equivalent to decreasing the length of time over which to perform each energy computation. This second step replaces the sum of squares operation again with a simpler lowpass filter. Thus the above-described filtering operation in accordance with the present invention results in a much simpler implementation of an instability precursor computation than through the use of DFTs.

Figure 3:
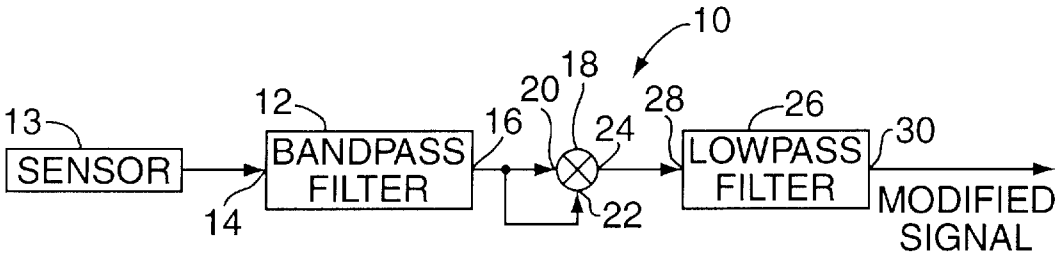
FIG. 3 schematically illustrates a system for real-time implementation of energy-type instability precursors in accordance with the present invention.
Figure 5:
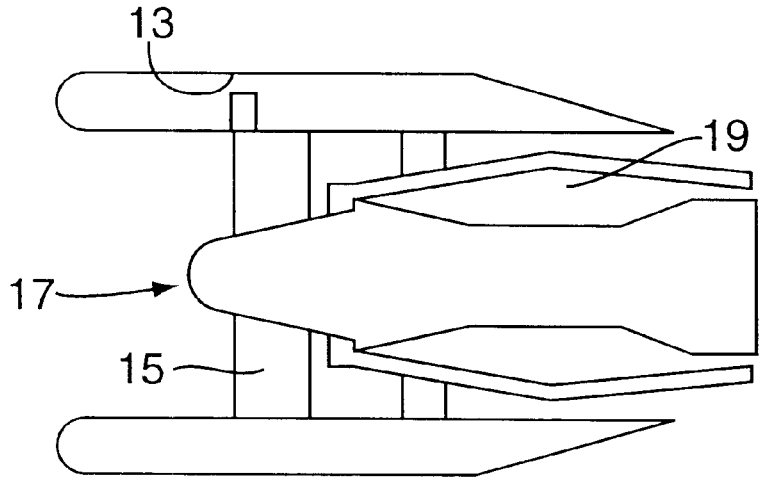
FIG. 5 schematically illustrates a sensor of the system illustrated in FIG. 3 positioned in a compressor portion of a turbofan engine.

Turning now to FIGS. 3 and 5, a system for the real-time implementation of energy-type instability precursors is generally designated by the reference number 10. The system 10 includes a bandpass filter 12 having an input 14 and an output 16. The input 14 of the bandpass filter 12 receives from a sensor 13 a time varying signal indicative of energy generated by a system, such as, for example, a pressure signal generated by static pressure sensors mounted near or strain gauges mounted on fan blades 15 in an aerocompression system or an electromagnetic signal generated by eddy current sensors of a turbofan engine 19. A multiplier circuit 18 has first and second inputs 20, 22, and an output 24. Each of the first and second inputs 20, 22 of the multiplier circuit 18 is coupled to the output 16 of the bandpass filter 12. A lowpass filter 26 has an input 28 and an output 30. The input 28 of the lowpass filter 26 is coupled to the output 24 of the multiplier circuit 18. The output 30 of the lowpass filter 26 carries a modified signal indicative of the time-varying energy within the compression system of a turbofan engine.

In operation, the bandpass filter 12 receives at its input 14 a time-varying signal, such as a static pressure signal from the sensor 13 and passes to the output 16 a bandpassed signal having a predetermined frequency range of, for example, about 250 Hz to about 310 Hz so as to pass the resonance frequencies generated by fan blades which are associated with precursors to aeromechanical instabilities, such as flutter. The bandpassed signal is then fed into the first and second inputs 20, 22 of the multiplier circuit 18 where the bandpassed signal is squared in magnitude so as to generate a squared signal at the output 24 of the multiplier circuit 18. Summing the magnitudes of the squared signals over the predetermined frequency range would lead to an infinite sum over infinite time and would result in a value proportional to the squared signal average. Instead, with the present invention the squared signal is fed to the input 28 of the lowpass filter 26 to generate an averaged and real-time energy signal at the output 30 of the lowpass filter 26 indicative of the sum of the squared signals. The real-time energy signal is then used to dampen or otherwise prevent the imminent instability from occurring.

Approximations to the preceding operation can be made, such as replacing the squaring operation of the bandpassed signal with a rectifying operation of the time-varying or AC signal, and other alternatives to the final lowpass filter for generating a sum of the squares operation of the bandpassed signal. Such techniques are advantageous because they can be implemented in analog, if necessary.

The system shown in FIG. 3 can be used to bandpass the time signal over a range of frequencies including the rotor frequency and possibly other frequencies which may be useful in predicting mechanical instabilities, and then apply the square operation and the lowpass filter. This would result in a time-varying signal which is proportional to the energy of the signal around and including the rotor frequency.

Another application of the disclosed method is to compute the DFF measure proposed by Tryfonidis in real-time. The measure is simply a computation of the energy associated with energy waves traveling in one direction around an annulus (positive frequencies) and the energy associated with waves traveling in the other direction (negative frequencies). The energy-type signals respectively associated with the positive and negative frequencies are separately passed through associated bandpass filters. Then one of the real-time signals associated with the positive or the negative frequencies is subtracted from the other signal to generate the instability precursor signal.

Figure 4:
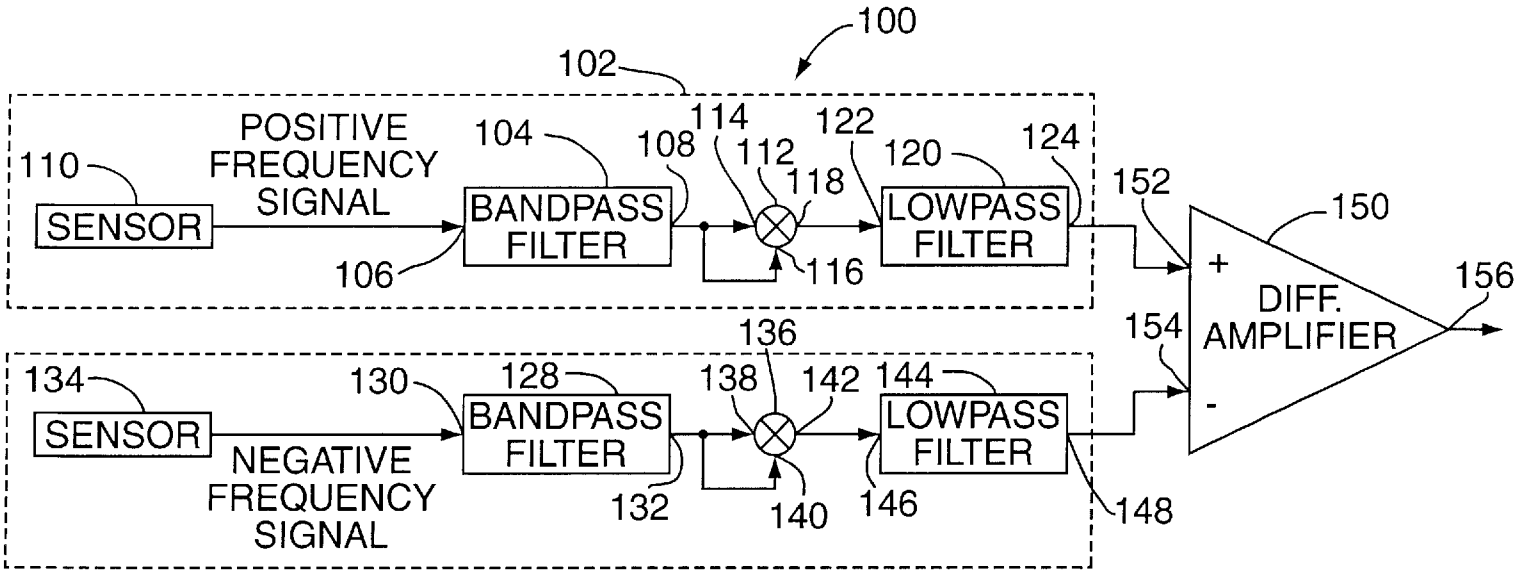
FIG. 4 schematically illustrates a second embodiment of a system for real-time implementation of energy-type instability precursors in accordance with the present invention.
Figure 6:
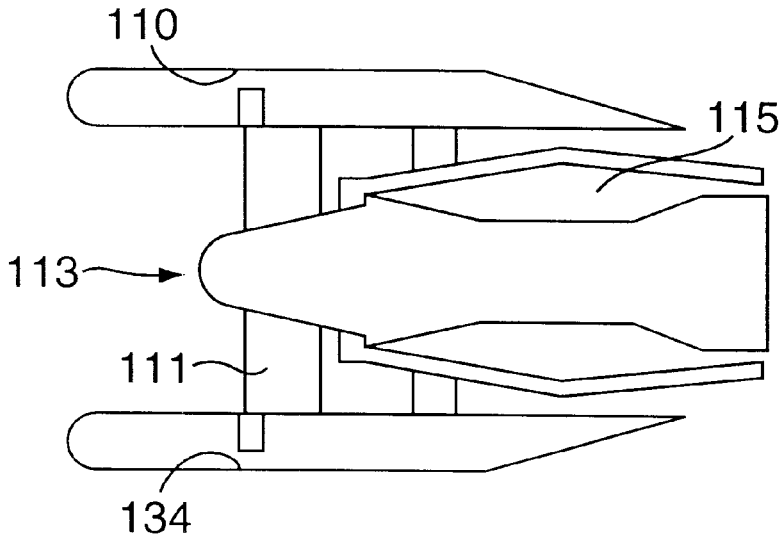
FIG. 6 schematically illustrates pressure sensors for the system illustrated in FIG. 4 positioned in a compressor portion of a turbofan engine.

FIGS. 4 and 6 schematically illustrate a system 100 for the real-time implementation of energy-type instability precursors that generates a modified real time signal from positive and negative frequencies. A first sub-circuit 102 for generating a first modified signal for positive frequencies (i.e., waves traveling in a first direction) includes a bandpass filter 104 having an input 106 and an output 108. The input 106 of the bandpass filter 104 receives a time-varying energy signal from a sensor 110, such as a pressure signal received from a static pressure sensor indicative of positive frequency waves detected by static pressure sensors or strain gauges or an electromagnetic signal generated by eddy current sensors provided near or on fan blades 111 in an aerocompression system 113 of a turbofan engine 115.

A multiplier circuit 112 has first and second inputs 114, 116, and an output 118. Each of the first and second inputs 114, 116 of the multiplier circuit 112 is coupled to the output 108 of the bandpass filter 104. A lowpass filter 120 has an input 122 and an output 124. The input 122 of the lowpass filter 120 is coupled to the output 118 of the multiplier circuit 112. The output 124 of the lowpass filter 120 carries a first modified signal indicative of the time-varying energy of positive frequencies within the compression system of a turbofan engine.

The embodiment of FIGS. 4 and 6 further includes a second sub-circuit 126 for generating a second modified signal for negative frequencies (i.e., waves traveling in a second direction that is opposite to that of the first direction). The negative frequency means includes a bandpass filter 128 having an input 130 and an output 132. The input 130 of the bandpass filter 128 receives a time-varying energy signal from a sensor 134, such as a pressure signal received from a static pressure sensor indicative of negative frequency waves detected by static pressure sensors or strain gauges or an electromagnetic signal generated by eddy current sensors provided near or on the fan blades 111 in an aerocompression system 113 of a turbofan engine 115. A multiplier circuit 136 has first and second inputs 138, 140, and an output 142. Each of the first and second inputs 138, 140 of the multiplier circuit 136 is coupled to the output 132 of the bandpass filter 136. A lowpass filter 144 has an input 146 and an output 148. The input 146 of the lowpass filter 144 is coupled to the output 142 of the multiplier circuit 136. The output 148 of the lowpass filter 144 carries the second modified signal indicative of the time-varying energy of negative frequencies within the compression system of a turbofan engine. A differential amplifier 150 has a non-inverting input 152, an inverting input 154, and an output 156. The non-inverting input 152 of the differential amplifier 144 is coupled to the output 124 of the lowpass filter 120 which carries the first modified signal, and the inverting input 154 of the differential amplifier 150 is coupled to the output 148 of the lowpass filter 144.

As mentioned above, the sensor 110, bandpass filter 104, multiplier circuit 112 and lowpass filter 120 form the first sub-circuit that generates a first modified signal (explained more fully above with respect to FIG. 3) indicative of positive frequencies (i.e., waves traveling in a first direction). The sensor 134, bandpass filter 128, multiplier circuit 136 and lowpass filter 144 form the second sub-circuit that generates a second modified signal similar to the generation of the first modified signal. The second modified signal is indicative of negative frequencies (i.e., waves traveling in a second direction opposite to that of the first direction). The first modified signal is fed to the non-inverting input 152 of the differential amplifier 150, and the second modified signal is fed to the inverting input 154 of the differential amplifier 150 which subtracts the second modified signal from the first modified signal to generate at the output 156 of the differential amplifier 150 a resultant modified signal indicative of a precursor to aerodynamic or aeromechanical instabilities.

As will be recognized by those skilled in the pertinent art, numerous modifications may be made to the above-described and other embodiments of the present invention without departing from the scope of the appended claims.

Accordingly, the detailed description of a preferred embodiment herein is to be taken in an illustrative, as opposed to a limiting sense.

What is claimed is:

1. A method for generating a real-time signal indicative of an energy-type instability precursor in a turbofan engine having a plurality of blades spaced substantially equidistant from each other about a rotational axis, comprising the steps of:

sensing periodically in real-time resonance waves associated with aerodynamic or aeromechanical resonance in a compressor portion of a turbofan engine and generating therefrom a real-time signal indicative of the energy of resonance;

bandpassing the real-time signal within a predetermined range of frequencies associated with precursors to aerodynamic or aeromechanical instabilities in turbofan engines to form a bandpassed signal;

squaring periodically in real time the magnitudes of the bandpassed signal to form a squared-magnitude signal;

summing the magnitudes of the squares of the bandpassed signal to form an instability precursor signal indicative of imminent aerodynamic or aeromechanical instabilities; and employing the real-time instability precursor signal to dampen or prevent the imminent instability from occurring.

2. A method as defined in claim 1, further including after the step of sensing the step of filtering the real-time signal to substantially include the frequencies of resonance associated with aerodynamic or aeromechanical instabilities.

3. A method as defined in claim 1, wherein the steps of squaring and summing include lowpassing the real-time signal.

4. A method for generating a real-time signal indicative of an energy-type instability precursor in a turbofan engine of an airplane or power plant, comprising the steps of:

sensing in real-time resonance waves associated with aerodynamic or aeromechanical resonances in a compressor portion of a turbofan engine and generating therefrom a real-time signal indicative of the energy of resonance;

bandpassing the real-time signal within a predetermined range of frequencies associated with precursors to aerodynamic or aeromechanical instabilities in turbofan engines to form a bandpassed signal;

squaring a magnitude of the bandpassed signal to form a squared-magnitude signal;

lowpassing the squared-magnitude signal to form an instability precursor signal indicative of imminent aerodynamic or aeromechanical instabilities; and employing the real-time instability precursor signal to dampen or prevent the imminent instability from occurring.

5. A method as defined in claim 4, wherein:

the step of sensing includes generating a first real-time signal indicative of energy of resonance waves traveling in a first direction, and generating a second real-time signal indicative of energy of resonance waves traveling in a second direction which is opposite to that of the first direction;

the step of bandpassing includes bandpassing the first real-time signal to form a first bandpassed signal, and bandpassing the second real-time signal to form a second bandpassed signal;

the step of squaring includes squaring the magnitude of the first bandpassed signal to form a first squared-magnitude signal, and squaring the magnitude of the second bandpassed signal to form a second squared-magnitude signal;

the step of lowpassing includes lowpassing the first squared-magnitude signal to form a first instability precursor signal, and lowpassing the second squared-magnitude signal to form a second instability precursor signal, and further including subtracting a magnitude of the second instability precursor signal from a magnitude of the first instability precursor signal to form a resultant instability precursor signal.

6. A method as defined in claim 5, wherein the step of sensing includes sensing the static pressure adjacent the turbofan blades.

7. A method as defined in claim 5, wherein the step of sensing includes employing active eddy current sensors outwardly from the turbofan blades for detecting when the turbofan blades pass the sensors.

8. A system for generating a real-time signal indicative of an energy-type instability precursor in a turbofan engine having a plurality of blades spaced substantially equidistant from each other about a rotational axis, the system comprising:

a sensor positioned in a compressor portion of a turbofan engine for sensing periodically resonance waves associated with aerodynamics and aeromechanics of fan blades in a compressor portion of a turbofan engine and generating therefrom a real-time signal, wherein the sensor detects pressure waves;

a bandpass filter for periodically receiving the real-time signal at an input and for passing to an output a bandpass signal derived from the real-time signal within a predetermined bandpass range of frequencies associated with precursors to mechanical instabilities in turbofan engines;

a multiplier circuit having two inputs each receiving the bandpassed signal for generating a squared-magnitude signal; and a lowpass filter receiving at an input the squared-magnitude signal to form an instability precursor signal indicative of a precursor to mechanical instability within a turbofan engine.

9. A system as defined in claim 8, wherein the bandpass filter, multiplier and lowpass filter form a first sub-circuit for generating a first frequency modified signal indicative of energy associated with waves traveling in a first direction, and further including a second sub-circuit including another bandpass filter, multiplier and lowpass filter for generating a second frequency modified signal indicative of energy associated with waves traveling in a second direction opposite to that of the first direction, and means for subtracting the second modified signal from the first modified signal to generate an instability precursor signal.

10. A system as defined in claim 9, wherein the subtracting means includes a differential amplifier.

11. A system as defined in claim 8, wherein the sensor is a strain gauge pressure sensor to be mounted on a turbofan blade.

12. A system as defined in claim 8, wherein the sensor is a static pressure sensor to detect static pressure variations associated with mechanical instabilities.

13. A system as defined in claim 8, wherein the sensor is an eddy current sensor for detecting mechanical resonance waves in turbofan blades indirectly by determining when the blades pass by the sensor.

* * * * *